United States Patent [19]

Eck

[11] 4,131,435

[45] Dec. 26, 1978

[54] AUTOMATIC CONTROL APPARATUS FOR OIL GAS MACHINE OPERATION

[75] Inventor: John C. Eck, Convent Station, N.J.

[73] Assignee: Wilputte Corporation, New Providence, N.J.

[21] Appl. No.: 798,386

[22] Filed: May 19, 1977

Related U.S. Application Data

[63] Continuation-in-part of Ser. No. 594,217, Jul. 9, 1975, abandoned.

[51] Int. Cl.[2] ..... C10G 9/04

[52] U.S. Cl. ..... 48/61; 48/74; 48/83; 48/87; 48/94; 55/227; 137/624.18; 261/19; 261/121R

[58] Field of Search ..... 48/61, 74, 80, 82, 83, 48/84, 87, 90, 95, 96, 94, 102 R, 102 A, 105, 107, 196 R, 214 R; 137/624.12, 624.18, 624.20; 55/227, 256; 261/19, 121 R

[56] References Cited

U.S. PATENT DOCUMENTS

| | | | |
|---|---|---|---|
| 1,663,557 | 3/1928 | Kennedy | 137/624.12 |
| 1,683,372 | 9/1928 | Plantinga | 48/83 |
| 1,828,461 | 10/1931 | Evans | 48/87 |
| 1,845,745 | 2/1932 | Gleason | 48/83 |
| 1,927,529 | 9/1933 | Pratt | 261/121 R |
| 1,956,321 | 4/1934 | Gartley | 48/87 |
| 2,373,519 | 4/1945 | Tweet | 261/121 R |
| 2,605,176 | 7/1952 | Pearson | 48/214 R |
| 2,927,847 | 3/1960 | Maccormac et al. | 48/214 R |
| 3,019,817 | 2/1962 | Whitlock | 137/624.18 |
| 3,533,764 | 10/1970 | Togneri | 48/61 |

*Primary Examiner*—S. Leon Bashore
*Assistant Examiner*—Peter F. Kratz
*Attorney, Agent, or Firm*—Buell, Blenko & Ziesenheim

[57] ABSTRACT

The specification discloses an automatic sequencing control system for operating a unit consisting of a pair of oil gas-producing generators in staggered sequence, each generator of which comprises a cooperating pair of reactor shells functioning alternately in a forward direction of product gas flow and in a reverse direction of product gas flow. The control system includes a start-up control, a burner control, a burner fuel ignition control, and an electric power failure control for heat and make periods of operation. An individual reverse flow wash box is provided for each generator and also a waste heat boiler common to both generators, valving for which is under control of sequencing control apparatus.

The method of operation of a pair of generators disclosed enables operation within a narrow range of temperatures for long periods of time and without necessity for repair or rebuilding of reactor chambers. Coincidentally, the method of operation disclosed requires minimal operating personnel attendance and enables full compliance with modern Environmental Protection (EPA) standards. Also, by-products in the form of tars and oils are produced without over-cracking and under-cracking and are on a par, qualitatively, with commercially produced tars and oils.

2 Claims, 6 Drawing Figures

Figure 1A:
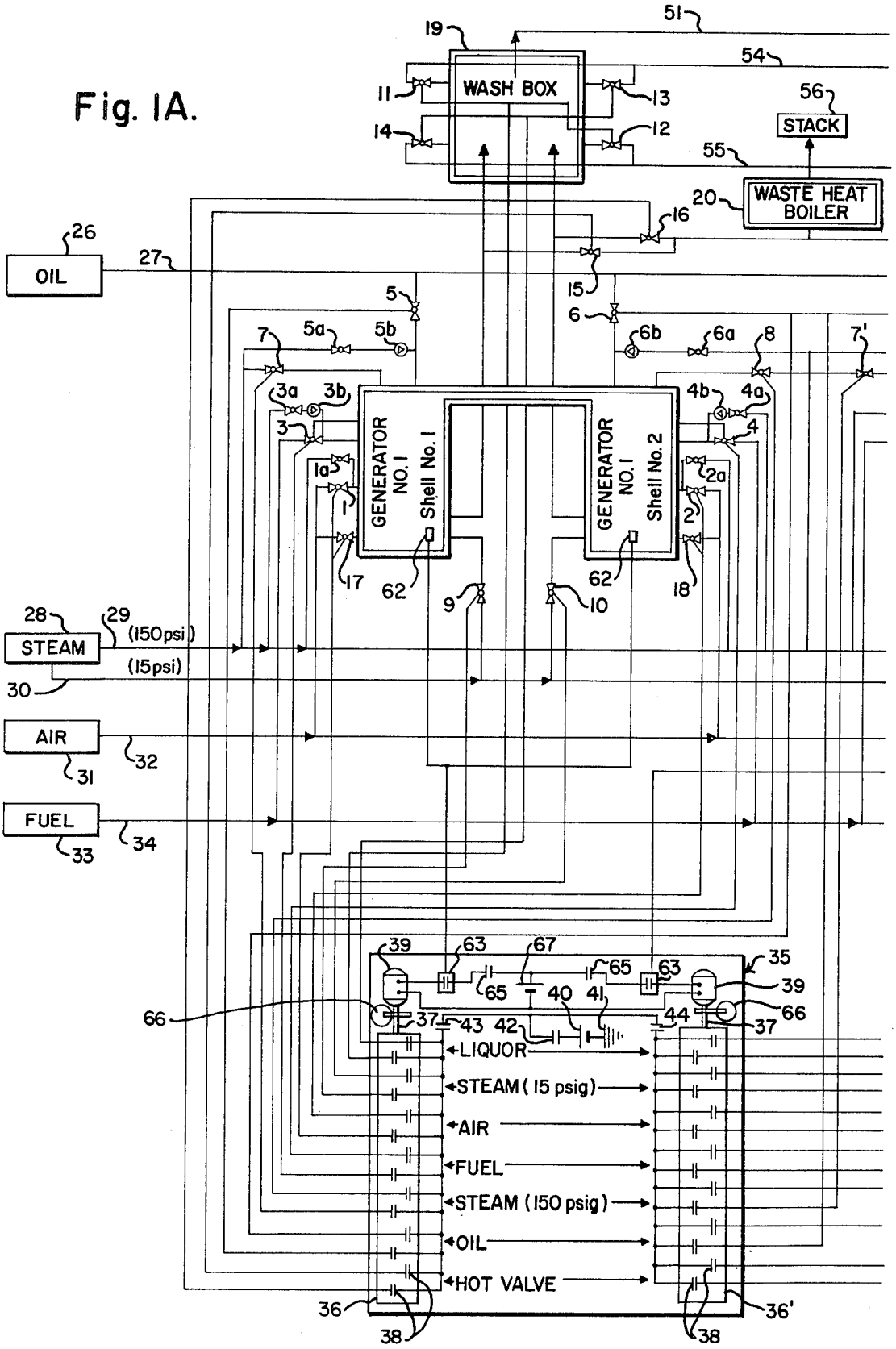

HYDRAULIC VALVE ARRANGEMENT
FORWARD HEAT PERIOD

AUTOMATIC CONTROL APPARATUS FOR OIL GAS MACHINE OPERATION

This application is a continuation-in-part of my co-pending prior application is a continuation-in-part of my co-pending prior application Ser. No. 594,217, filed July 9, 1975, abandoned upon the filing of this application.

This invention relates to an automatic sequencing control system for operating a pair of gas-producing generators, each of which comprises two reactor shells alternately serving in reversed relation to produce alternate reversed flow of product gas therethrough. The control system further enables the "heat" and "make" periods of two gas generators to be staggered so that one of the reactor shells has a heat period in progress while another reactor shell of the second generator has a make period in progress thereby assuring almost constant use of a waste heat boiler common to both generators for recovery of heat from the gases used during the "heat" period, as well as continuous production of product gas.

Apparatus or machines for manufacturing combustible gases from hydrocarbons or oils have been known for some time. Oil gasification plants may comprise a single gas generator or any number of units. Two gas generators are arranged as a unit in order to utilize a common waste heat boiler for full time use and to obtain a continuous flow of product gas. Prior patents 2,605,176; 3,120,430 and 3,156,544 disclose apparatus for making combustible gas. Patent 2,605,176 discloses a so-called four-zone reverse directional flow system in which two adjacent reactor shells are alternately reversed in operation so as to provide four periods, a "heat" period, a "make" gas period, a reverse "heat" period and a reverse "make" period with purges between the periods. The patent discloses a system of manually operated valves for effecting the reverse directional heat and make periods. Patent 3,120,430 discloses apparatus providing a continuous process for generating low gravity high B.T.U. gas utilizing automatic controllers for the volume of gaseous products of combustion or steam to function as a carrier gas for the oil vapors as well as controllers for controlling the amount of hydrocarbon gas making fluid fed to the reaction zone. Prior patent 3,156,544 discloses apparatus providing a continuous process for making gas of desired B.T.U. and gravity from available hydrocarbon feeds, such as gas oils. The patent relates primarily to structural details of the reactor shells.

A more recent patent 3,533,764 discloses gas making apparatus comprising multiple pairs or trains of reactors stepped through process cycles in staggered relation by sequence control means involving electronic computerized elements of some degree of complexity.

During the period beginning around 1950, while natural gas supplies were plentiful, machine production of fuel gas was not warranted competitively with natural gas. In more recent years, after natural gas became in short supply and an energy crisis developed, the need and commercial desirability for machine production of fuel gas became magnified and of prime consideration in the national economy. At the same time, with the increasingly strict imposition of environmental protection standards and regulations, the existing known gas machines and systems have proved inadequate and unsuited for the economical continuous operation required for present day commercial operation.

It is accordingly the purpose of this invention to provide an automatic control system of relative simplicity for effecting sequence control of valving whereby a pair of gas generators or machines are operated in staggered relation through repeated cycles over extended periods of time with minimum repair or rebuilding of reactor chambers.

It is a further purpose to provide an automatic control system for a pair of gas generators which enables economical operation with assured dependability and minimum personnel attendance, and in full compliance with environmental protection standards and requirements.

The control system comprises sequence control means in the form of a rotary sequence switch or a plurality of synchronized rotary switches for electrically controlling hydraulically operated valves for timed control of burner fuel, air, process steam, a gas producing liquid such as oil, and purging steam. The system comprises thermocouples suitably disposed in forward and reverse make reactor chambers for controlling the operation of the burners in the corresponding heat chambers to limit the maximum temperature for pyrolysis of the oil spray. Moreover, the method of timing and duration of periods of operation of the burners, and periods of supply of burner air, process steam, and process oil is such as to enable control of the temperature in the reactor chamber, in which the oil spray undergoes pyrolysis, so as to limit the range of variation of the temperature. The exact timing gives assurance of continual trouble-free operation, without danger of explosion or other hazardous occurrences, including violation of EPA standards. Moreover, the overcracking and undercracking of oil in process is avoided, with the result that the by-product tars and oils are, qualitatively, on a par with other commercially produced tars and oils.

The system further provides a temperature sensor located in the burner assembly to safeguard the ignition of burner fuel. The sensor closes a circuit through a spark gap when the burner fuel valve is on and when the radiant temperature is below the ignition temperature of the fuel gas. Automatic emergency shut down is effected by hydraulic pressure in the hydraulic system which closes valves in the process oil and process steam lines if electric power fails during the make period. Similarly, the hydraulic pressure closes the valves in the burner fuel and burner air lines if electric power fails during the heat period. Electrically controlled solenoid valves in the sequence control automatically relieve system hydraulic pressure holding any valves open, on interruption of electric power, the valves thereupon being spring-biased to closed position.

Figure 1B:
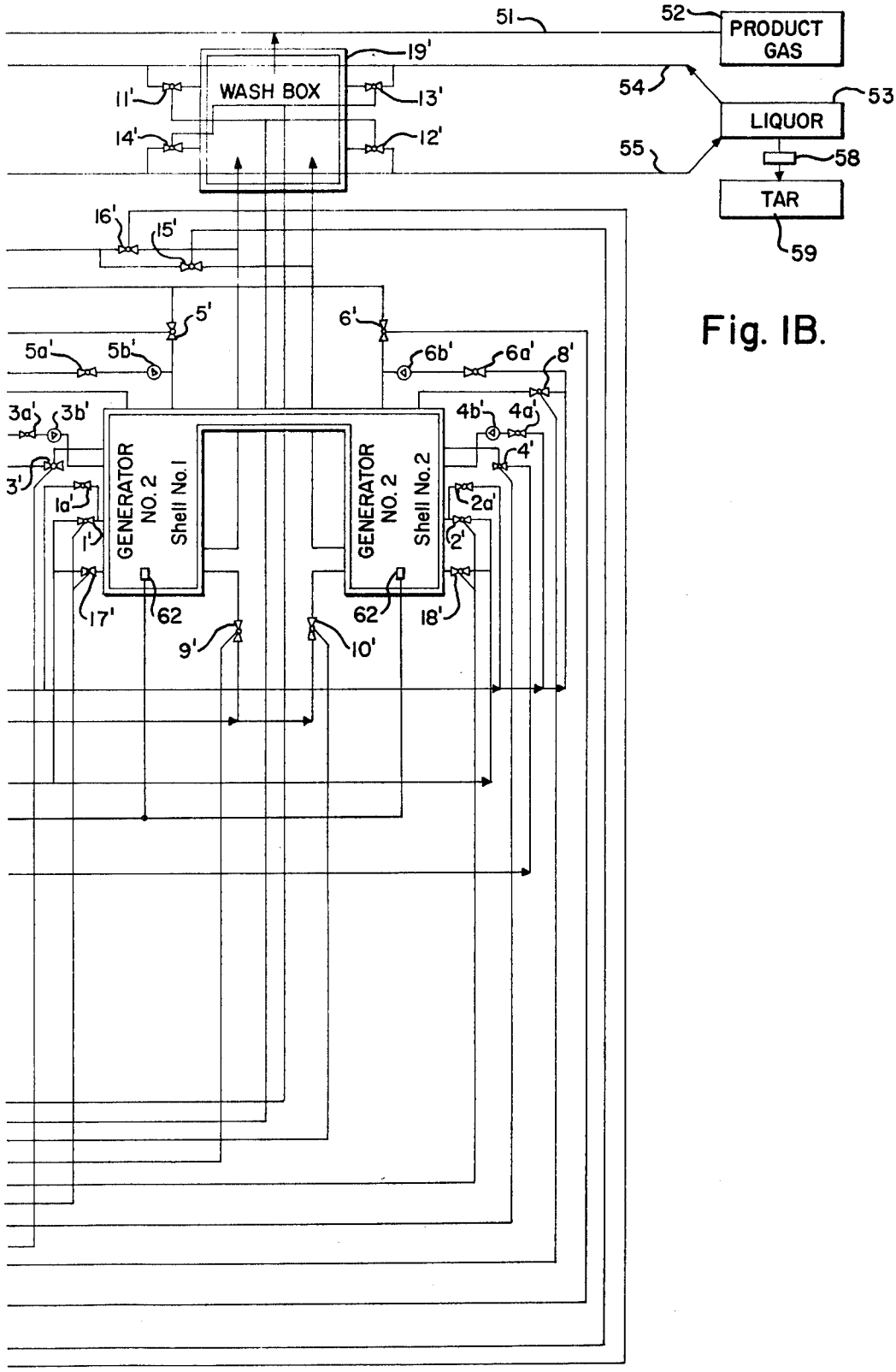
Figure 2:
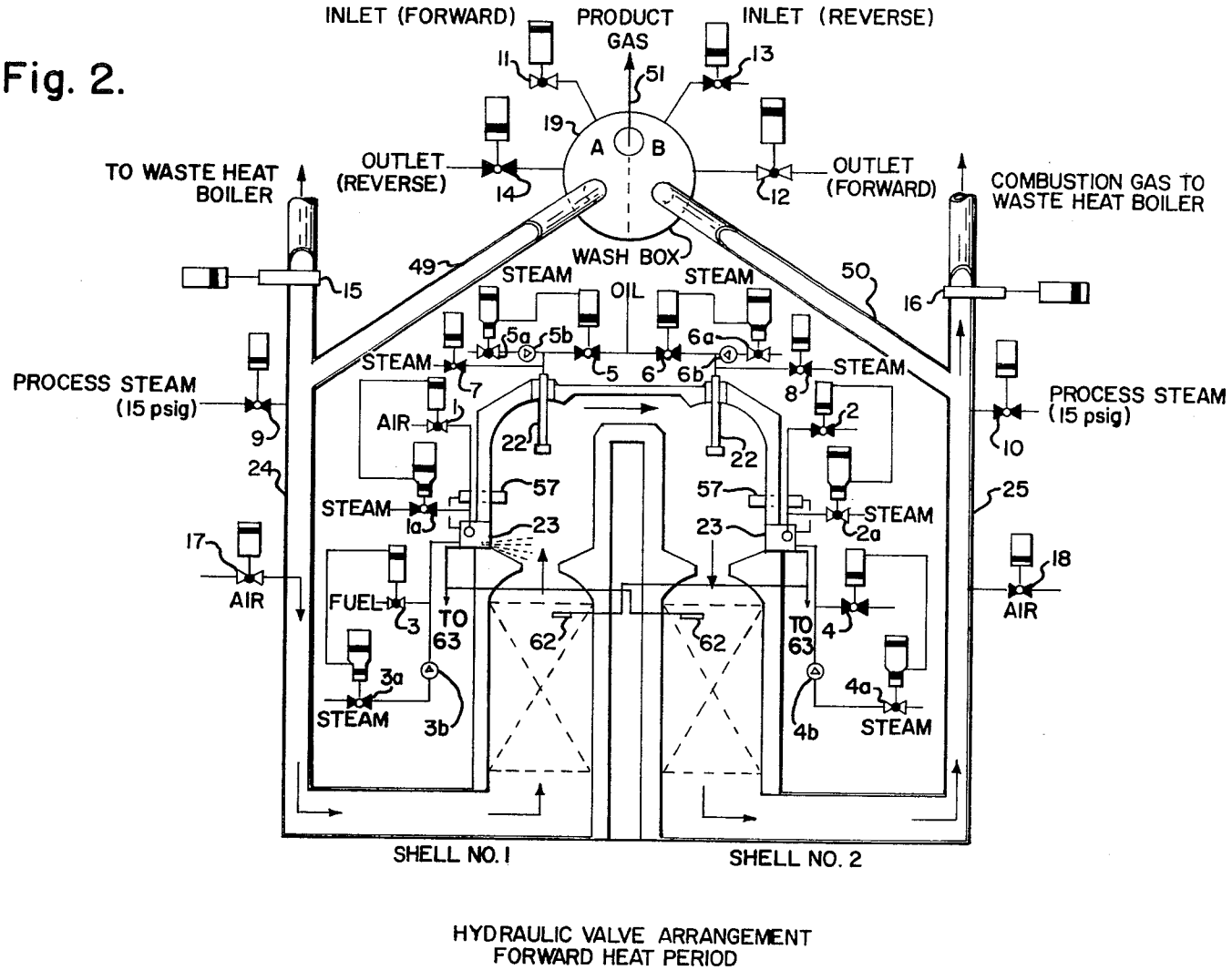
Figure 3:
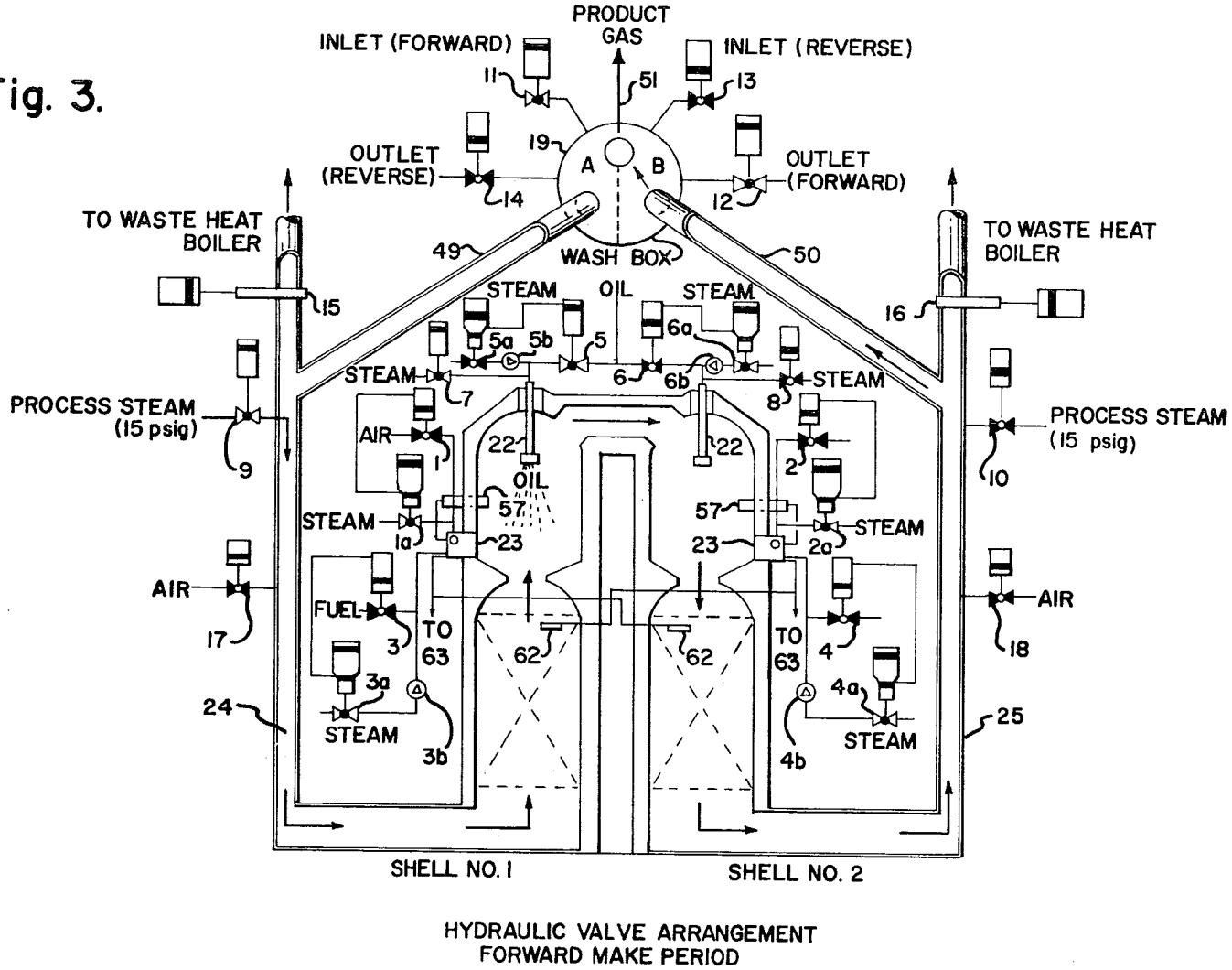
Figure 4:
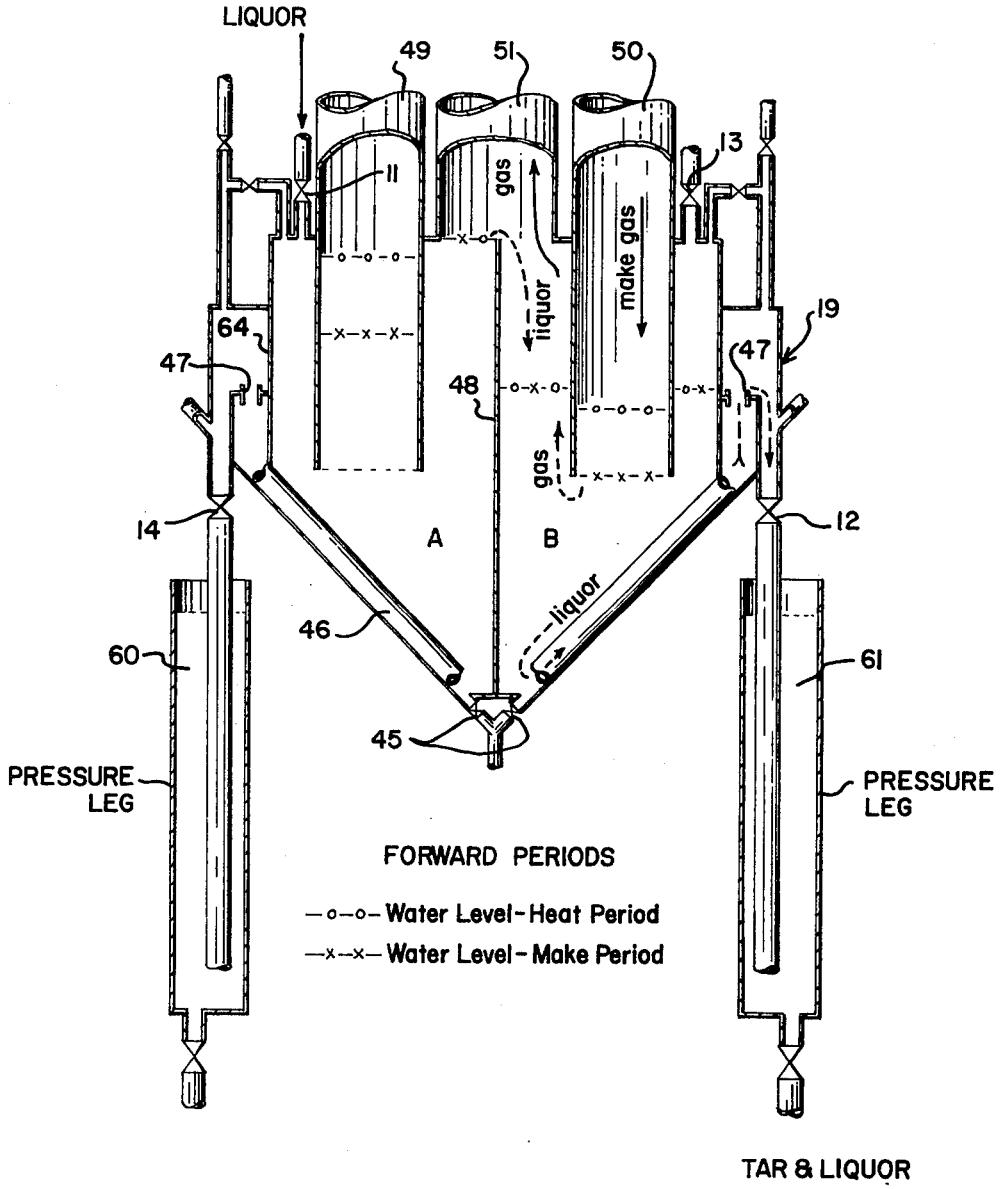
Figure 5:
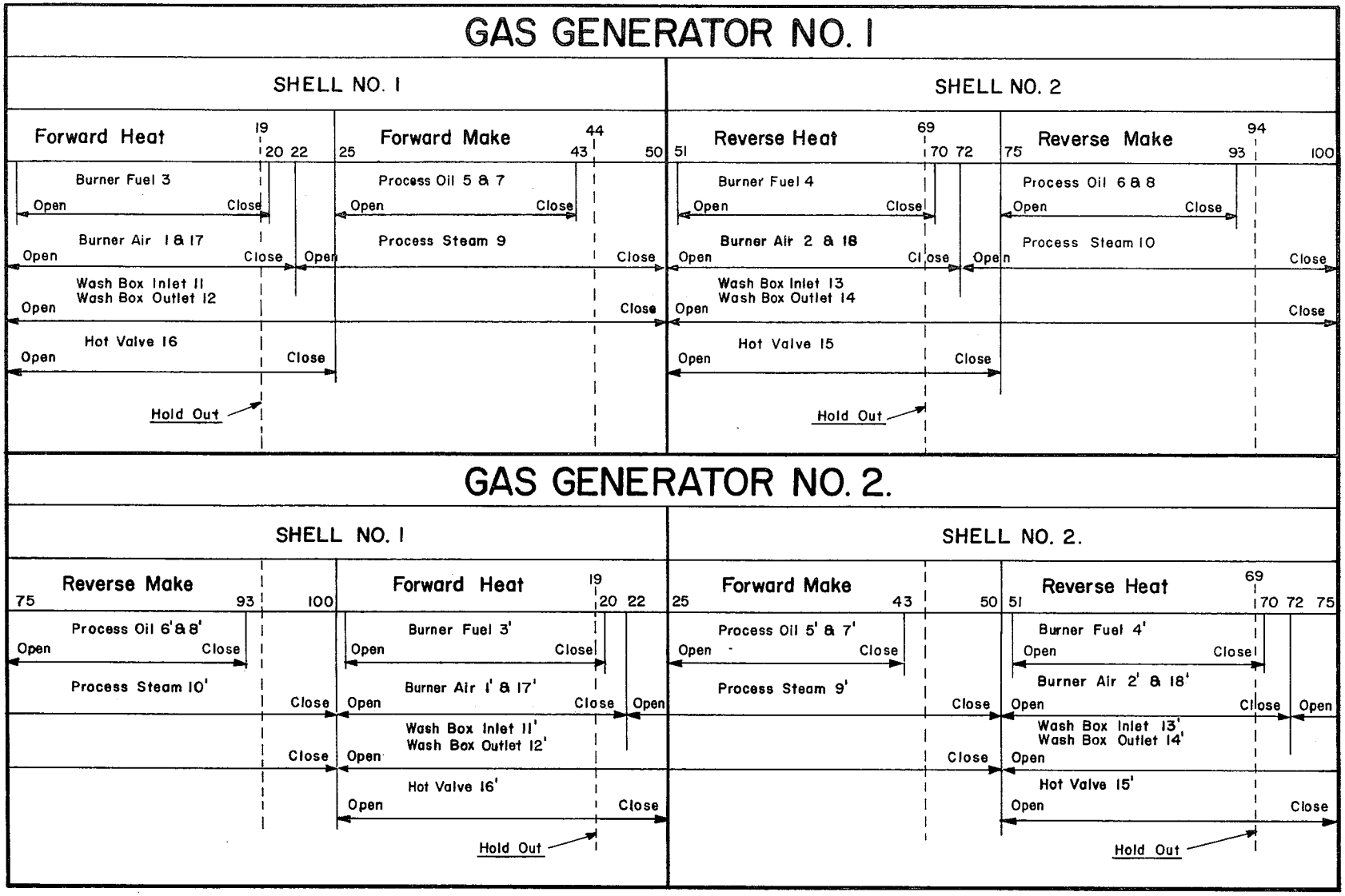

A more detailed description of the automatic controls for oil gas machine operation is set forth hereinafter taken in conjunction with the accompanying drawings wherein:

FIGS. 1A and 1B, when joined together in side-by-side relation with the right side of FIG. 1A registering with the left side of FIG. 1B, constitute a diagrammatic view of a system of controls for a unit of two generators, FIG. 2 is a somewhat more detailed diagrammatic view of a single generator, showing the two reactor shells and wash box therefor, together with the control valves for process oil and steam, fuel, air and purge steam depicted in position for the Forward Heat Period of Operation, FIG. 3 is a similar diagrammatic view corresponding to FIG. 2 except that the valves are depicted in position for the Forward Make Period of Operation, FIG. 4 is a simplified diagrammatic view of a wash box depicting the path of flow of wash liquor and of product gas therethrough, and FIG. 5 is a sequence chart showing the sequence timing and duration of the various steps in the two generators, for a complete cycle of operation; namely Forward Heat, Forward Make, Reverse Heat and Reverse Make.

Referring to FIGS. 1A and 1B, the two generators are designated and identified as Generator No. 1 and Generator No. 2. Each generator comprises two shells which are designated No. 1 and No. 2 respectively in FIGS. 1A, 1B, 2 and 3. For simplicity, only the Generator No. 1 will be described in detail, it being understood that the Generator No. 2 is substantially identical and that corresponding elements therein or associated therewith are identified by the same reference numerals with the prime (') suffix.

As shown in FIGS. 2 and 3, the shells designated No. 1 and No. 2 are vertically arranged refractory lined vessels, substantially identical in construction and connected at the tops by a cross-over passage. Each vessel is constructed to provide two superposed chambers the upper chamber being empty and the lower chamber being almost filled with checkerbrick or refractory material with voids therebetween to permit passage of gas or steam therethrough from bottom to top or vice versa. A refractory lined riser pipe, hereinafter referred to, is associated with each vessel. Each riser pipe is connected at its bottom end to the base of the lower refractory filled chamber. The upper ends of the riser pipes are connected selectively to a washbox 19 as hereinafter described, and to a common waste heat boiler 20 by valves presently to be identified by reference numerals.

At the top of the upper chamber of shell No. 1 (FIGS. 2 and 3) is a nozzle 22 to which process oil under pressure is supplied under the control of a valve 5, and also high pressure steam (150 psi) selectively under the control of a valve 5a and a valve 7. Nozzle 22 is preferably of the type disclosed and claimed in expired patent 2,755,134 of which I am co-inventor. Similarly, process oil under pressure is supplied to a similar nozzle 22 at the top of the upper chamber of shell No. 2 under the control of a valve 6, while steam under pressure (150 psi) is supplied thereto selectively under control of a valve 6a and a valve 8. Nozzles 22 cause oil spray emitted therefrom to be so finely atomized that pyrolysis of the oil particles occurs without actual contact with the walls of the upper chambers of either shell No. 1 or No. 2. Damage to and erosion of ceramic blocks constituting the walls of the chambers is thus avoided, enabling continual operation of the generators for long uninterrupted periods of time without down-time for repair or rebuilding. Heat for heating the chamber of the shells No. 1 and No. 2 is provided by corresponding burners 23 located at one side of the upper chamber just above the necked passage connecting the upper and lower chambers. Fuel (oil, tar or gas) is supplied to these burners under control of valves 3 and 4 respectively. The burners using oil or tar may be steam atomizing burners although the steam lines are not shown in the figures. Air for combustion is supplied to the burners under control of valves 1 and 2 respectively. High pressure (150 psi) steam is also supplied to the wind boxes of the burners under control of valves 1a and 2a respectively. High pressure steam is also supplied to the burners, for purging them, under control of valves 3a and 4a respectively.

A thermocouple 62 is provided near the top of the checkers in the lower chamber of each generator shell, each thermocouple being connected to and controlling the fuel burner 23 in the opposite shell, as shown in FIGS. 2 and 3, to control the temperature in the top of the checkers (for forward and reverse flow operation) to the range of 1400°–1600° F.

Low pressure process steam is supplied into the riser pipe 24 for shell No. 1 under control of a valve 9. Air under pressure is supplied into this same riser pipe, but not simultaneously with process steam, under control of a valve 17. Similarly, low pressure process steam is supplied into the riser pipe 25 for shell No. 2 under control of a valve 10, and air under pressure is supplied into this same riser pipe, but not simultaneously with steam, under control of a valve 18.

Valves 15 and 16 are provided for controlling the connection of the respective riser pipes 24 and 25 for shells No. 1 and No. 2 through the waste heat boiler 20 (see also FIG. 1A) to the stack 56.

Flow of liquid, hereinafter called wash liquor, through the respective wash boxes 19 and 19' (see FIGS. 1A and 1B) is under control of cooperating pairs of valves. One pair of valves 11 and 12 are opened to provide passage for flow of liquor through the wash box in one direction. Another pair of valves 13 and 14 are opened to provide passage for flow of liquor through the wash box in the opposite direction. Corresponding valves for wash box 19' for Generator No. 2 are designated by the same reference numerals with the prime (') suffix.

The valves hereinbefore identified by reference numerals are similar in construction. As diagrammatically represented in FIGS. 2 and 3, these valves are operated by pistons subject to hydraulic fluid pressure which in turn is controlled by solenoid operated four-way valves (not shown). For simplicity, the hydraulic supply lines and the hydraulic system are omitted from the drawings, except in FIGS. 2 and 3 for certain hydraulic connections between interconnected valves as presently described.

Supply of electric current to the solenoid valve portions of the valves is effected by individual control wires hereinafter described except in the case of process valves 1 to 6. The valves 1 to 6 are hydraulically interlocked, as indicated in FIGS., 1,2 and 3, so that a single control wire controls each valve 1 to 6 and its associated steam purge valve 1a to 6a, respectively. Thus when any of the valves 1 to 6 is energized so as to be actuated to its open position, the hydraulic pressure activating the associated valve 1a to 6a, is reversed so as to cause the valve 1a to 6a to be actuated to its closed position and vice versa. Accordingly when any of valves 1 to 6 is in closed position, its associated steam valve 1a to 6a is in open position. The hydraulic connection between the valves 1 to 6 and corresponding valves 1a to 6a is indicated in FIGS. 2 and 3.

Check valves 3b and 4b are interposed respectively between valves 3 and 3a in the one case and between valves 4 and 4a in the other case, in order to block flow of fuel oil except to the burner. With the fuel oil valves 3 and 4 closed, however, steam may be supplied past the check valves to the burners.

Similarly check valves 5*b* and 6*b* are interposed between valves 5 and 5*a* on the one hand and between valves 6 and 6*a* on the other hand to block flow of process oil except to the nozzles 22. With the valves 5 and 6 closed, however, steam may be supplied past the check valves 5*b* and 6*b* respectively, to the nozzles.

Piping connections are shown in FIGS. 1A and 1B for the supply of various processing elements, such as oil, steam (both high and low pressure) pressurized air and fuel to the Generators No. 1 and No. 2. Sources of elements are represented in block form but it will be understood that appropriate containers, vessels and reservoirs are provided. It will be seen that there is a common source 26 of process oil for both Generators No. 1 and No. 2 which is supplied via a pipe 27. Also there is a suitable source 28 of steam which is supplied via a high-pressure (150 psi) pipe 29 and a low-pressure (15 psi) pipe 30. There is a source 31 of pressurized air which is supplied via a pipe 32. Also there is a source 33 of fuel which is supplied via a pipe 34.

Sequence control of the hereinbefore identified valves for the two gas generators is provided by apparatus comprising a control panel or console 35, including two similar sequence switches 36 and 36', one for each gas generator, operated in synchronism. Sequence switches 36 and 36' may be consolidated in one switch mechanism if desired, though two separate but synchronized sequence switches are preferred.

Sequence switches 36 and 36' are not shown in detail but each may comprise essentially a rotary shaft 37 having a series of coaxial cam discs for actuating pairs of microswitches 38 to closed position over a predetermined sector or number of degrees of a complete revolution in predetermined sequence and angular relation. The rotary shaft 37 of each sequence switch is driven by a motor 39 at a slow speed (e.g. 8 RPH) directly or indirectly through a speed-reduction gear mechanism so as to provide a full revolution of the shaft in a desired interval of time. Each motor 39 is controlled as hereafter described. Each microswitch 38 is arranged in circuit with the solenoid of a corresponding one or more of the before described valves, so as to actuate the valve or valves to open or closed position as desired, while the microswitch remains in closed position. For simplicity, the circuitry for control of the valves is illustratively depicted in FIGS. 1A and 1B as of the single-wire type comprising a suitable source of voltage 40, one terminal of which is grounded at 41, a master switch 42 and individual manually-operated switches 43 and 44 for Generators No. 1 and No. 2 respectively. It will be understood, however, that dual-wire ungrounded circuitry may be provided for control of the valves, if desired.

Specific identification of the lead wires from the sequence switches 36 and 36' to the valves is deemed unnecessary in view of the legends adjacent the switches identifying the nature of control exercised, such as liquor, steam, air, etc.

Referring now to FIG. 4, there is shown diagrammatically the structure of a wash box 19. Essentially the wash box is a vessel in the form of a circular tank 64 the bottom of which is of inverted cone shape and provided with two drain valves 45. Two pipes 46 are welded to the cone bottom of the wash box to conduct liquor from the bottom of the wash box to over flow at weirs 47 through pressure legs 60 and 61 to the tar decanter 53. Pressure legs 60 and 61 are vertical liquor-filled tubes open at the top to atmospheric pressure to reduce the pressure of the circulating liquor to atmospheric pressure. Tank 64 is divided by a central vertical partition 48 into two compartments A and B respectively. Extending into and submerged below the level of liquor in the compartments A and B, respectively, are make gas inlet pipes 49 and 50 to which riser pipes 24 and 25 of Generator No. 1 are connected respectively. Straddling the upper edge of partition 48 is the open end of an exit gas pipe 51 into which gas flowing into either compartment A or B, via pipes 49 and 50, may rise and pass to a product gas holder 52 (FIG. 1B).

As will be made more apparent later on, during the forward phase (heat and make periods) of operation, liquor is circulated from a suitable source, such as a tar decanter 53, to compartment A via a pipe 54 and the inlet valve 11. When the level of the liquor in compartment A rises to the top of partition 48, it overflows into compartment B whence it rises through pipes 46 to the level of one of the weirs 47 and returns via open valve 12 and a pressure leg 61 back to the tar decanter 53 via a return pipe 55. Tar is removed from the decanter by means of pump 58 to a tar tank 59. As will become apparent later on, the combustion gas produced in shell No. 1 during the forward heat period is emitted to the waste heat boiler 20 via the open valve 16. During the reverse phase of operation (heat and make periods) of the gas generators the flow of liquor through the wash box is reversed, flowing via inlet valve 13, compartment B to compartment A and thence via open outlet valve 14 to tar decanter 53. Similarly hot valve 15 is open during the reverse heat period to allow emission of gas produced in shell No. 2 to the waste heat boiler.

One of the features involved in the control system is burner fuel ignition control. Referring to FIGS. 2 and 3, a temperature sensor 57 is provided as a part of the assembly of each burner 23, the purpose being to safeguard the ignition of the burner fuel. Sensor 57 operates to close a circuit through a spark gap when the burner fuel valve 3 (or 4) is open and when the radiant temperature within the shell is below the ignition temperature of the fuel gas. Sensor 57 is effective during the starting period of the gas generators but during normal operation is not activated. However, it serves as a safety feature in the event that below-ignition temperatures exist.

It will be understood that the console 35 is provided with an adjusting knob (not shown) for setting the control temperature and also a kick-out switch (not shown) for manually controlling the heat period on start-up. The kick-out switch shuts off the burner fuel and then a predetermined length of time later (such as 9 seconds) shuts off the main and burner air flows. Process steam and process oil valves are not activated on start-up and the sequencing control switches return to normal at 50 or 100% of their full revolution cycle.

Upon start-up of a gas generator, the main control switch 42 is first closed and then one of the individual starting switches 43 or 44 is closed. After one of the generators has been started, the starting switch for the other generator is closed to start the second generator. Each generator is gradually heated up to the control temperature, set by the adjusting knob hereinbefore referred to, by gradually lengthening the "heat" period in each shell. The inactive "make" periods serve to allow time to soak up the heat and thus more evenly distribute the heat. When the control temperature is reached, the kick-out switch is no longer used and the further operation is under the automatic control of the sequencing switches 36 and 36'. Also, burners 23 are under the automatic control of thermocouples 62 as before described.

Once the operation of the two Generators No. 1 and No. 2 is placed under automatic control, the sequence and duration of operation of the various valves hereinbefore described, is as depicted in the sequence chart of FIG. 5.

It will be noted that, as the chart shows, the two sequencing switches are synchronized so that "heat" and "make" periods (both forward and reverse) of one generator, for example Generator No. 1, are staggered in time with regard to the corresponding periods of the other generator. It will also be noted that the complete revolution of the shaft 37 of rotary sequencing switches 36 and 36' is represented by 100, and that therefore the operation, closing or opening, of a valve is represented as taking place at a given percentage of the full cycle.

Referring, for example, to Gas Generator No. 1, Shell No. 1, in the chart of FIG. 5, it will be seen that at the beginning of the cycle, at 0% or slightly thereafter, the following valves are operated to open position: burner fuel valve 3, burner air valve 1, main air valve 17, wash box inlet and outlet valves 11 and 12 respectively, and hot valve 16. The open position of these valves is also represented in FIG. 2.

As the sequence switch 36 continues its rotation, burner fuel valve 3 is operated to closed position at 20% and burner air valve 1 and main air valve 17 are both simultaneously closed at 22%. At the instant fuel valve 3 closes, steam valve **3*a* opens to supply purge steam to the burner assembly and remains open until the forward make period operation is completed at 50% of full cycle. At 22% of full cycle, when burner air valve 1 and main air valve 17 close, the associated steam valve 1*a*** is operated to open position to supply purge steam to the wind box of the burner and remains open until termination of the forward phase at 50% of full cycle.

Also at 22% of full cycle, process steam valve 9 is operated to open position and remains open to the end of the forward "make" period at 50% of full cycle.

At 25% of full cycle, the end of the forward "heat" period of operation and the beginning of the forward "make" period of operation, the process oil valve 5 is opened, as is steam valve 7, to inject a mixture of process oil and steam into the upper chamber of shell No. 1 via nozzle 22. The point of 25% of full cycle also marks the closing of the hot valve 16 to cut off the waste heat boiler 20. The wash box inlet and outlet valves 11 and 12 remain open until the forward phase of operation is completed at 50% full cycle and are then closed.

Process oil valve 5 and high pressure steam valve 7 close at 43% of full cycle. With the closing of valve 5, steam valve **5*a* is opened to supply purge steam to purge and cleanse the nozzles 22** and to prevent over-heating thereof.

The chart in FIG. 5 does not show the portion of full cycle that steam valves **3*a*, 1*a* and 5*a*** remain open, but it will be understood that they close at the termination of the forward "make" period of operation at 50% of full cycle.

In consequence of the operation of the valves in the sequence above described, it will be seen that the forward "heat" conditions are first fulfilled in the two Shells No. 1 and No. 2 of Generator No. 1, followed by forward "make" conditions. Essentially, Shells No. 1 and No. 2 are heated to the set control temperature by the flame from burner 23 of Shell No. 1, and regulated to such temperature under control of the thermocouples 62, following which, process oil and process steam are injected into Shell No. 1 by nozzle 22 thereof. The supply of process steam via valve 9 causes the mixture of oil and steam to flow through the cross-over and undergo steam pyrolysis in the second Shell No. 2, from which the product gas flows up the riser pipe 25 and via pipe 50, compartment B and outlet pipe 51 to the product gas holder 52. The hot valve 16 remained open only during the "heat" period to utilize heat recovery by the waste heat boiler 20, and was closed at the beginning of the "make" period to establish flow of product gas via pipe 50 to the wash box 19.

At 50% of full cycle, the operation is reversed. From the chart in FIG. 5, it will be seen that at the 50% point, or slightly after, the following valves associated with Shell No. 2 of Generator No. 1 are operated to open position: burner fuel valve 4, burner air valve 2, main air valve 18, hot valve 15, and inlet and outlet valves 13 and 14 of wash box 19. Similarly, burner fuel valve 4 is operated to closed position at 70% whereas the burner air valve 2 and main air valve 18 are closed at 72%, this same instant marking the opening of process steam valve 10, which recloses at the end of the reverse "make" period at 100%.

At the instant burner fuel valve 4 is closed, burner steam valve **4*a* is opened to cause high pressure steam flow past check valve 4*b*** to and through the burner assembly for purging purposes.

At the instant (72%) valves 2 and 18 are closed, the process steam valve 10 is opened, thereby driving the flow of product gas, as it is produced, reversely through the crossover from Shell No. 2 to Shell No. 1.

At the 75% point of the cycle, process oil valve 6 and steam valve 8 are opened, producing an oil-steam mixture in the upper chamber of Shell No. 2, which undergoes pyrolysis in the upper and lower chambers of Shell No. 1, and then flows out of the bottom of Shell No. 1 into riser pipe 24 and thence, with hot valve 15 closed (at 75%), through pipe 49, and the liquor in compartment A of wash box 19 to pipe 51 and thence to the product gas holder 52.

It will be noted in FIG. 5, that the gas Generator No. 2 is operated concurrently and similarly but in displaced or staggered time sequence to gas Generator No. 1. Thus it will be seen that the forward "heat" period of gas Generator No. 2 is initiated at the instant (25%) that the forward "heat" period of gas Generator No. 1 is terminated. The sequence of operation of the control valves for Generator No. 2 occurs at the same percentage of full cycle as for Generator No. 1, it being noted that the valves for Generator No. 2 are designated with prime (') suffixes.

The timing and synchronization of two gas generators to operate in staggered relation is a difficult and skillful operation involving a method of arduous trial and error. Moreover, I have found that my control system is preferably limited to a pair of generators, each of which has two shells, making a total of four shells since it is thus possible to have one shell of either generator on "heat" or "make" at all times. Ordinarily, experience has shown it is desirable for the "heat" period to have a duration of less than 25% of the full cycle (100%) of operation and for the "make" period to have a duration of more than 25% of the full cycle. It will be seen from the chart of FIG. 5, that in consequence of actual trial, I prefer to compromise on a period duration for "heat" and "make" of exactly 25% of the full cycle time (100%). Moreover, the exact percentage of full cycle operation, for the duration of supply of burner fuel, burner air, process oil and process steam, has been determined by trial and error and has not been arbitrarily selected.

It should be understood that a position indicator disc 66 for each generator is provided in the console 35 for indicating the exact percentage position of full cycle for each generator at all times. This may take the form of a disc mechanically driven from the shaft 37 of the corresponding sequence switches 36 and 36'.

It will be noted that in the chart in FIG. 5, certain positions of the sequence switches are designated "hold-out." Thus, in Shell No. 1 at 19% and Shell No. 2 at 69%, of either generator, such "hold-out" position is designated. The term "hold-out" refers to the hold-out or extension of the "heat" periods to permit the control temperature to reach the set point temperature, accomplished by stopping rotation of the sequence switches. A thermocouple controlled over-ride switch 63 is provided in the circuit of each of the motors 39 driving the sequence switches for accomplishing starting and stopping thereof. A control thermocouple 62 for this purpose is located near the top of the checkers in each generator shell, as shown in FIGS. 2 and 3. A manual switch 65 in series with the over-ride switch 63 in each motor circuit serves to initially set up the circuit connection to a source, such as battery 67.

The effect of such "hold-out" operation is to concurrently prolong the steam flow during the "make" period that is simultaneously timed in the other generator and thus not upsetting the timing sequence. In order to avoid decreased hourly gas production rate as a result of "hold-outs," burner fuel and burner air flow rates are then manually adjusted.

In normal operation or in an emergency, the generators may be shut down by opening the manual switch 43 or 44 for the corresponding generator at 21% or 71% of full cycle. The generator is thus left full of air and with one hot valve open (see FIG. 5). In a multi-generator plant, each generator is shut down in the same way near the end of one of its "heat" periods. For final shut down, the main control switch 42 should be opened.

It will be apparent that in the event of power failure, the automatic control apparatus effects closing of all feed lines to the generators. Thus if the power fails during the "make" period, the existing pressure of the hydraulic fluid functions to close the valves 5 and 7 in the process oil and process steam lines. Similarly, the existing hydraulic fluid pressure functions to close the valves 3 and 1 in the burner fuel and burner air lines, if the power fails during the "heat" period. Thus in the event of power failure, the generators will be left in safe condition. The hot valves 15 and 16 will simply remain closed with the generators full of product gas if shut-down occurs during the "make" period.

To accomplish the above control, four-way hydraulic valves are used in the process lines. Failure of electric current supply to the valve solenoids causes the release of hydraulic pressure in the lines to the various valves, thus insuring that any hydraulic pressure holding a valve open will be released so as to allow the valve to close. Steam valves 1*a*, 2*a*, 3*a*, 4*a*, 5*a* and 6*a* are examples of valves in which hydraulic pressure could maintain the valve in an unsafe open position. In the event of power failure, the controlling solenoids are de-energized and spring action is used to return the hydraulic valves to the safe shut down position.

The above unit apparatus is described as comprising two generators only but it will be apparent that additional apparatus units, each consisting of a pair of generators similarly controlled, may be employed for increased rate and volume of gas production. It will be understood also that other modifications in the apparatus may be made within the scope of the appended claims.

I claim:

1. In automatic control apparatus for a unit comprising a pair of oil gas generators each of the type comprising two reactor shells operative alternately in a reverse directional flow system for the production of product gas, and wherein each of said gas generators comprises:

(a) inlet and outlet conduits for fuel, air, process oil, process steam, purge steam and product gas;

(b) solenoid controlled valves in said conduits for said two reactor shells of each of said gas generators for controlling burner fuel supply, burner air supply, process oil supply, process steam and burner purging steam therefor;

(c) rotary sequence switch means comprising a plurality of individual switches;

(d) circuitry so connecting each one of the switches of said switch means to at least one of said valves that rotation of said switch means effects operation of the valves of each one said generators in a manner to cause forward heat and forward make periods incident to rotation of said switch means through 50% of a full revolution, and reverse heat and reverse make periods for the same generator in the succeeding 50% of a full revolution of said switch means; and (e) a wash box for each one of said pair of generators each wash box having two compartments via which product gas from the corresponding generators alternately passes to a receiver, the improvement wherein valve means is provided for reversing flow of liquid through the compartments of each of the said wash boxes, and wherein circuitry is provided between said sequence switch means and said valve means to cause flow of liquid through the wash boxes in one direction for forward phases of operation and in a reverse direction for reverse phases of operation of the corresponding generators.

2. In automatic control apparatus for a unit comprising a pair of oil gas generators each of the type comprising two reactor shells operative alternately in a reverse directional flow system for the production of product gas, and wherein each of said gas generators comprises:

(a) inlet and outlet conduits for fuel, air, process oil, process steam, purge steam and product gas;

(b) solenoid controlled valves in said conduits for each of said two reactor shells of each of said gas generators for controlling burner fuel supply, burner air supply, process oil supply, process steam and burner purging steam therefor;

(c) a separate rotary sequence switch device for each one of said pair of generators and separate motor means for driving said rotary switch devices;

(d) circuitry so connecting each one of the switches of said switch devices to at least one of said valves that rotation of said switch devices effects operation of the valves of each one said generators in a manner to cause forward heat and forward make periods incident to rotation of said switch devices through 50% of a full revolution, and reverse heat and reverse make periods for the same generator in the succeeding 50% of a full revolution of said switch devices, and said switch devices being so synchronized that operation of one of the pair of generators leads the operation of the other by 25% of a full revolution of the switch devices, thereby initiating a forward heat period in the said other of said pair of generator units at the time a forward make period is initiated in the said one generator unit;

(e) a wash box for each one of said pair of generators each wash box having two compartments via which product gas from the corresponding generators alternately passes to a receiver; and (f) a common waste heat boiler to which combustion gases from all of said shells of said generator units may flow, the improvement wherein valve means is provided for reversing flow of liquid through the compartments of each of the said wash boxes; and wherein circuitry is provided between said separate sequence switch devices and said valve means to cause flow of liquid through the wash boxes in one direction for forward phases of operation and in a reverse direction for reverse phases of operation of the corresponding generators, and wherein solenoid valve means is provided controlled by said separate sequence switch devices for permitting combustion gas flow to the waste heat boiler from the corresponding generator only during the forward heat and reverse heat phases of operation thereof.

* * * * *

UNITED STATES PATENT AND TRADEMARK OFFICE

CERTIFICATE OF CORRECTION

PATENT NO. : 4,131,435

DATED : December 26, 1978

INVENTOR(S) : JOHN C. ECK

It is certified that error appears in the above-identified patent and that said Letters Patent are hereby corrected as shown below:

Column 1, line 6, after "application" delete "is a continuation-in-part of my"; line 7, delete "co-pending prior application".

Signed and Sealed this

*Third* Day of *July 1979*

[SEAL]

*Attest:*

*Attesting Officer*

LUTRELLE F. PARKER

*Acting Commissioner of Patents and Trademarks*